United States Patent [19]

Deel

[11] 4,445,733

[45] May 1, 1984

[54] GROUNDING RING FOR SHIELDED CABLE

[76] Inventor: Gary G. Deel, 1289 4th St., #B, Los Osos, Calif. 93402

[21] Appl. No.: 389,191

[22] Filed: Jun. 17, 1982

[51] Int. Cl.[3] ..... H01R 4/24; H01R 4/66

[52] U.S. Cl. ..... 339/14 R; 339/97 R; 339/274

[58] Field of Search ..... 339/14 R, 96 R–99, 339/279

[56] References Cited

U.S. PATENT DOCUMENTS 2,856,592 10/1958 Carlson ..... 339/274 X

FOREIGN PATENT DOCUMENTS 983766 2/1965 United Kingdom ..... 339/274

1109914 4/1968 United Kingdom ..... 339/97 R

*Primary Examiner*—Eugene F. Desmond

*Attorney, Agent, or Firm*—Robert F. Beers; Joseph M. St.Amand

[57] ABSTRACT

The device uses a grounding ring, having both an outer and an inner ring element combination, which is placed about a shielded cable to be grounded. The inner ring has a multitude of grounding spikes cammed to move in a radially inward direction in response to rotation of the outer ring and pierce any outer insulation and the metal shielding sufficiently to make good electrical contact with the cable shielding about its circumference.

5 Claims, 4 Drawing Figures

GROUNDING RING FOR SHIELDED CABLE

STATEMENT OF GOVERNMENT INTEREST

The invention described herein may be manufactured and used by or for the Government of the United States of America for governmental purposes without the payment or any royalties thereon or therefor.

BACKGROUND OF THE INVENTION

This invention relates to electrical cables and more particularly to a novel and simplified means for circumferentially grounding the outer shield of a double shielded electrical cable. The device will also operate on single shielded cables and similar items.

Presently, methods for providing a grounding path-/path of continuity to the outer shield of an electrical cable requires stripping away a portion of the outer insulating (e.g., vinyl) jacket; making an electrical contact with the braided wire shield; and, then recovering the exposed shielding with an insulation and waterproofing material. Such methods are complex, time consuming and expensive.

SUMMARY OF THE INVENTION

The present device overcomes the disadvantages of the prior methods, and provides a fast, convenient, simple, and inexpensive means for making a good electrical grounding connection to the outer shielding of an insulated shielded cable.

The present invention uses a grounding ring which fits contiguously about the outer surface of a shielded cable, having both an outer and an inner ring element combination, which is placed about the outer insulating layer of the shielded cable to be grounded. The inner ring has a multitude of needlelike grounding spikes positioned within radial passageways therein. The grounding spikes are cammed to move in a radially inward direction in response to rotation of the outer ring due to cam shaped grooves on the inner surface of the outer ring. As the grounding spikes move radially inward, they pierce the outer insulative jacket of the cable and then pierce the braided metal shielding at a great many points sufficiently to make good electrical contact with the cable shielding for 360° about its periphery.

It is therefore an object of this invention to provide an improved grounding connector means for insulated shielded electrical cable and the like.

Other objects and features will be pointed out in the following description and claims and illustrated in the accompanying drawings which discloses by way of example, the principle of the invention and the best mode contemplated for carrying it out.

DESCRIPTION OF THE PREFERRED EMBODIMENTS

Figure 1:
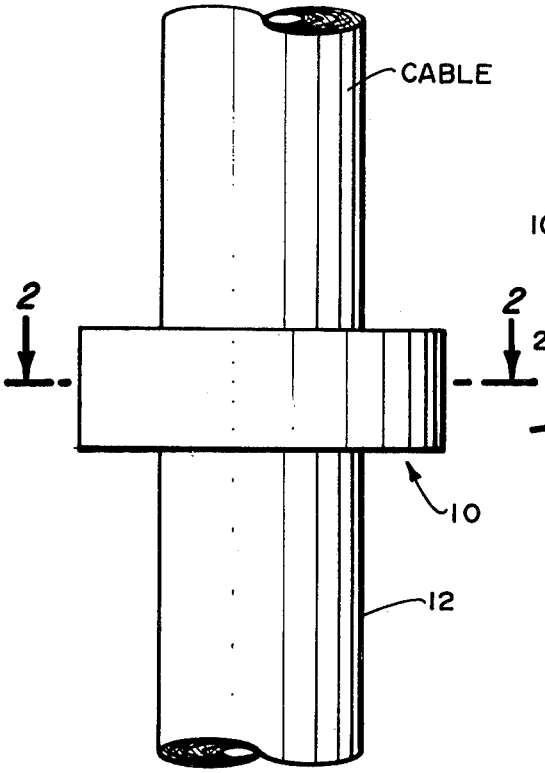
FIG. 1 shows a section of shielded electrical cable having a grounding ring thereon.
Figure 2:
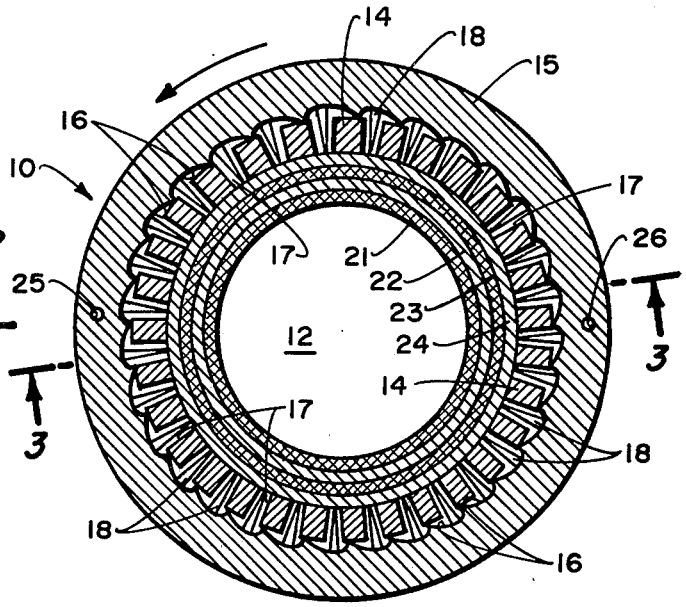
FIG. 2 is a cross-sectional view of the grounding ring device and cable taken along section line 2—2 of FIG. 1.
Figure 3:
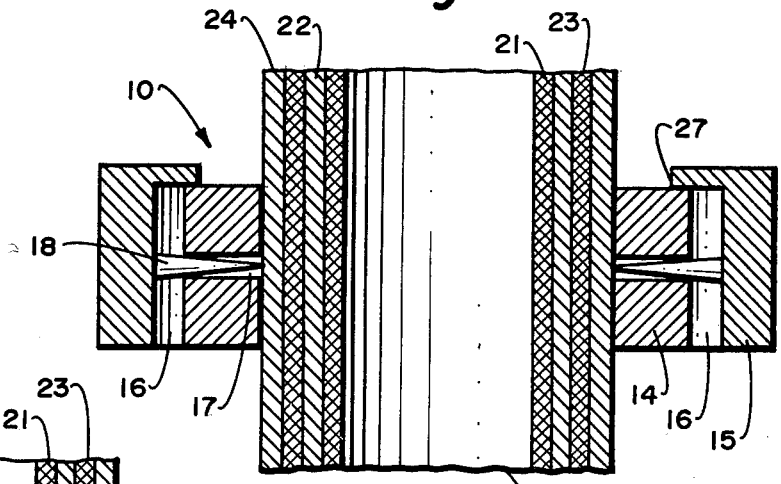
FIG. 3 is a cross-sectional view taken along section line 3—3 of FIG. 2.

As shown in FIG. 1, a grounding ring/continuity coupler 10, of the present invention, is attached about an electrical cable 12. Coupler 10 consists of an electrically conductive inner ring 14 and an electrically conductive outer ring 15 concentric therewith. The inner surface of outer ring 15 is provided with a plurality of cam surfaces 16 located about the circumference thereof, as shown in FIGS. 2 and 3. Inner ring 14 fits adjacent and contiguous to the outer surface of cable 12, and has a large number of closely spaced radially positioned passageways 17 extending therethrough which are about the entire circumference of inner ring 14. Each of passageways 17 has an electrically conductive needlelike grounding spike 18 which slideably fits therein as shown in FIG. 2. Each of the numerous grounding spikes about the circumference of inner ring 14 has a corresponding adjacent cam surface 16 in outer ring 14, as shown. The length of each of grounding spikes 18 is greater than the length of a passageway 17 through inner ring 14. In general, the length of each grounding spike 18 will be only slightly less than the distance from the inner surface of inner ring 14 to the bottom of the grooves 16 which form the cam surface on the inside of concentric outer ring 15, i.e., where outer ring 15 is at its largest inside diameter, as particularly shown in FIGS. 2 and 3.

Figure 4:
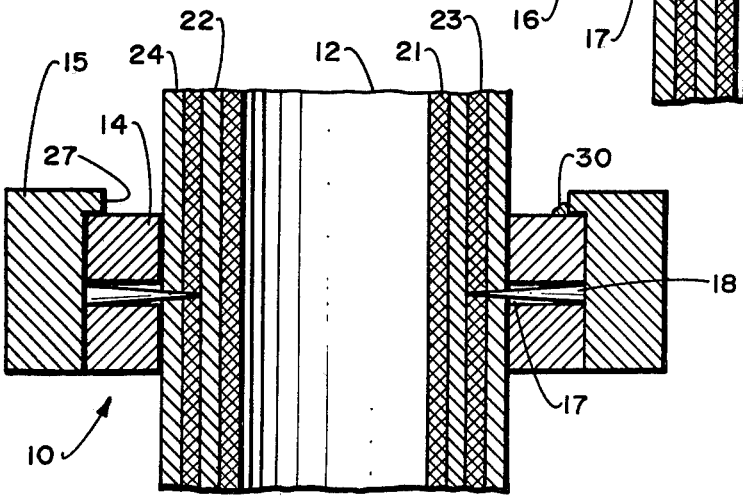
FIG. 4 is a cross-sectional view similar to that of FIG. 3, but with the outer cam ring rotated slightly to cause grounding spikes to penetrate the insulation and outer grounding shield of the cable.

By way of example, electrical cable 12 is shown in FIGS. 2, 3 and 4 to have an interior electrically conductive braided shield 21, for example, an interior vinyl insulating jacket 22, an outer electrically conducting braided shield 23, for example, and an outer vinyl insulating jacket 24. The inner shield 21, or both the inner jacket 22 and inner shield 21 can be omitted, or outer jacket 24 could be omitted, depending upon the type of cable, or the like, being used, and the device will still operate as intended.

Wrench placement holes 25 and 26, for example, as shown in FIG. 2, or other convenient means, can be provided to rotate concentric outer ring 15 sufficiently to cause the cam surfaces 16 to drive grounding spikes 18 radially inward due to the camming action of cam surfaces 16 against the outward ends of grounding spikes 18. This will result in the multitude of needlelike tips of grounding spikes 18 moving from the position shown in FIGS. 2 and 3, to the position shown in FIG. 4, where they pierce the outer insulating jacket 24 with minimal applied force and extend into the electrical shield 23 to make electrical connection with shield 23 at numerous points of contact about the periphery of the cable. Inner ring 14 and outer ring 15, are in good electrical contact with each and with grounding spikes 18, which are in contact with shield 23, thus providing electrical continuity between the entire periphery of outer shield 23, inner ring 14, and outer ring 16. The needlelike spikes 18 are guided radially during their inward movement by passageways 17 in inner ring 14. Electrical connections for grounding purposes can then readily be made with outer ring 16, by welding or any other suitable means.

A flange 27, for example, or other means can be provided on one or both edges of outer ring 15, if desired, to retain the outer ring in position about inner ring 14 or prevent slipping between the two rings. Once the grounding spikes have pierced the cable at numerous points to make peripheral contact with the shielding, as shown in FIG. 4, rings 14 and 15 can be locked in position by means as a weld 30, or any other suitable means, not shown, including means to unlock the position of the rings.

The total length of the ground spikes and alignment of the outer ring is critical. Once the ground spikes are set and the rings fixed in relative position with each other, a conductive caulking or coating can be applied to keep out moisture and insure good conductivity.

A latitude of modification, change and substitution is intended in the foregoing disclosure and in some instances, some features of the invention will be employed without a corresponding use of other features in making electrical and other connections. Accordingly, it is appropriate that the appended claims be construed broadly and in a manner consistent with the spirit and scope of the invention herein.

What is claimed is:

1. A grounding ring device for making 360° peripheral electrical continuity connection to the shielding of shielded electrical cable assemblies having one or more insulating layers and one or more shielding layers about the electrical cable, comprising:

a. an electrically conductive inner ring operable to fit contiguously about the outer surface of and electrically shielded cable assembly;

b. an electrically conductive outer ring in close electrical contact and concentric with said inner ring;

c. said inner ring provided with a multitude of radially aligned passageways closely spaced circumferentially there about and extending therethrough;

d. said outer ring provided with critically aligned cam grooves closely spaced circumferentially about the inner surface thereof, respective to and equal in number to the multitude of radial passageways in said inner ring;

e. separate individual electrically conductive needlelike grounding spike slideably positioned in each of the closely spaced radial passageways of said inner ring and having a drive end thereof extending into a respective one of said cam grooves;

f. each of said cam grooves providing a camming surface operable to bear against the drive end of a respective one of said needlelike grounding spikes; rotation of said outer ring concentrically about said inner ring for a distance approximately equal to the width of one of said cam grooves being operable to move the cam surface of each said cam groove against the drive end of each respective grounding spike and thereby move all said grounding spikes radially inward in their respective radial passageways forcing said grounding spikes to pierce the outer surface of said electrical cable assembly and provide peripheral electrical continuity connection with the electrical cable shielding for efficient grounding thereof.

2. A device as in claim 1 wherein the length of said grounding spikes is determined by the depth of penetration into an electrical cable assembly necessary to penetrate any insulation and make good contact with the shielding layer.

3. A device as in claim 1 wherein means is provided in retain the outer ring together and concentric with said inner ring.

4. A device as in claim 1 wherein the maximum length of said grounding spike is the depth of a cam groove plus the length of a radial passageway in said inner groove.

5. A device as in claim 1 wherein means is provided to lock the inner and outer rings together to hold the grounding spikes in penetrating position in contact with the cable shielding.

* * * * *